US006751432B2

(12) United States Patent
Gervasi

(10) Patent No.: US 6,751,432 B2
(45) Date of Patent: Jun. 15, 2004

(54) ORGANOMETALLIC COMPOSITION COATINGS FOR ELECTRODE MEMBERS IN A DEVELOPER APPARATUS

(75) Inventor: David J. Gervasi, West Henrietta, NY (US)

(73) Assignee: Xerox Corporation, Stamford, CT (US)

( * ) Notice: Subject to any disclaimer, the term of this patent is extended or adjusted under 35 U.S.C. 154(b) by 25 days.

(21) Appl. No.: 10/137,789

(22) Filed: May 2, 2002

(65) Prior Publication Data

US 2003/0206753 A1 Nov. 6, 2003

(51) Int. Cl.[7] ..... G03G 15/08
(52) U.S. Cl. ..... 399/266
(58) Field of Search ..... 399/266, 292, 399/293

(56) References Cited

U.S. PATENT DOCUMENTS

| | | | | |
|---|---|---|---|---|
| 5,761,587 | A | 6/1998 | Laing et al. | 399/266 |
| 5,778,290 | A | 7/1998 | Badesha et al. | 399/266 |
| 5,787,329 | A | 7/1998 | Laing et al. | 399/266 |
| 5,805,964 | A | 9/1998 | Badesha et al. | 399/266 |
| 5,848,327 | A | 12/1998 | Badesha et al. | 399/99 |
| 5,999,781 | A | 12/1999 | Gervasi et al. | 399/266 |

*Primary Examiner*—Quana Grainger
(74) *Attorney, Agent, or Firm*—Annette L. Bade

(57) ABSTRACT

An apparatus and process for reducing accumulation of toner from the surface of an electrode member in a development unit of an electrostatographic printing or copying apparatus by providing an organometallic coating composition including an organometallic material on at least a portion of the electrode member.

22 Claims, 4 Drawing Sheets

ORGANOMETALLIC COMPOSITION COATINGS FOR ELECTRODE MEMBERS IN A DEVELOPER APPARATUS

BACKGROUND OF THE INVENTION

The present invention relates to apparatuses for development of images, and more specifically, to electrode members for use in a developer unit in electrostatographic printing or copying machines, or in digital imaging systems such as, for example, the Xerox Corporation 220 and 230 machines. Specifically, the present invention relates to methods and apparatuses in which at least a portion of a development unit electrode member is coated with a coating composition, and in embodiments, an organometallic coating. In embodiments, electrode member history, damping and/or toner accumulation is controlled or reduced, and the wires maintain the properties of favorable charge interactivity and wear.

Generally, the process of electrophotographic printing or copying includes charging a photoconductive member to a substantially uniform potential so as to sensitize the photoconductive member thereof. The charged portion of the photoconductive member is exposed to a light image of an original document being reproduced. This records an electrostatic latent image on the photoconductive member. After the electrostatic latent image is recorded on the photoconductive member, bringing a developer into contact therewith develops the latent image. Two component and single component developers are commonly used. A typical two component developer comprises magnetic carrier granules having toner particles adhering triboelectrically thereto. A single component developer typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of single component development system is a scavengeless development system that uses a donor roll for transporting charged toner to the development zone. At least one, and preferably a plurality, of electrode members are closely spaced to the donor roll in the development zone. An AC voltage is applied to the electrode members forming a toner cloud in the development zone. The electrostatic fields generated by the latent image attract toner from the toner cloud to develop the latent image.

Another type of a two component development system is a hybrid scavengeless development system, which employs a magnetic brush developer roller for transporting carrier having toner adhering triboelectrically thereto. A donor roll is used in this configuration also to transport charged toner to the development zone. The donor roll and magnetic roller are electrically biased relative to one another. Toner is attracted to the donor roll from the magnetic roll. The electrically biased electrode members detach the toner from the donor roll forming a toner powder cloud in the development zone, and the latent image attracts the toner particles thereto. In this way, the latent image recorded on the photoconductive member is developed with toner particles.

Various types of development systems have herein before been used as illustrated by the following:

U.S. Pat. No. 4,868,600 to Hays et al. describes an apparatus wherein a donor roll transports toner to a region opposed from a surface on which a latent image is recorded. A pair of electrode members is positioned in the space between the latent image surface and the donor roll and is electrically biased to detach toner from the donor roll to form a toner cloud. Detached toner from the cloud develops the latent image.

U.S. Pat. No. 4,984,019, to Folkins discloses a developer unit having a donor roll with electrode members disposed adjacent thereto in a development zone. A magnetic roller transports developer material to the donor roll. Toner particles are attracted from the magnetic roller to the donor roller. When the developer unit is inactivated, the electrode members are vibrated to remove contaminants therefrom.

U.S. Pat. No. 5,124,749 to Bares discloses an apparatus in which a donor roll advances toner to an electrostatic latent image recorded on a photoconductive member wherein a plurality of electrode wires are positioned in the space between the donor roll and the photoconductive member. The wires are electrically biased to detach the toner from the donor roll so as to form a toner cloud in the space between the electrode wires and the photoconductive member. The powder cloud develops the latent image. A damping material is coated on a portion of the electrode wires at the position of attachment to the electrode supporting members for the purpose of damping vibration of the electrode wires.

U.S. Pat. Nos. 5,300,339 and 5,448,342 both to Hays et al. disclose a coated toner transport roll containing a core with a coating thereover.

U.S. Pat. No. 5,172,170 to Hays et al. discloses an apparatus in which a donor roll advances toner to an electrostatic latent image recorded on a photoconductive member. The donor roll includes a dielectric layer disposed about the circumferential surface of the roll between adjacent grooves.

U.S. Pat. No. 5,761,587 discloses coating a low surface energy coating on at least a portion of the electrode member.

U.S. Pat. No. 5,787,329 discloses coating at least a portion of an electrode member with an organic coating.

U.S. Pat. No. 5,805,964 discloses coating at least a portion of an electrode member with an inorganic coating.

U.S. Pat. No. 5,778,290 discloses coating at least a portion of the electrode member with a composite coating.

U.S. Pat. No. 5,848,327 discloses coating compositions for development electrodes including a polymer, lubricant and inorganic material.

U.S. Pat. No. 5,999,781 discloses coating compositions for development electrodes including a polyimide or epoxy resin, an optional lubricant, and metal compound selected from the group consisting of chromium (III) oxide, zinc oxide, cobalt oxide, nickel oxide, cupric oxide, cuprous oxide, chromium sulfate and cadmium sulfide.

Primarily because the adhesion force of the toner particles is greater than the stripping force generated by the electric field of the electrode members in the development zone, a toner tends to build up on the electrode members. Accumulation of toner particles on the wire member causes non-uniform development of the latent image, resulting in print defects. This problem is aggravated by toner fines and any toner components, such as high molecular weight, crosslinked and/or branched components, and the voltage breakdown between the wire member and the donor roll.

One specific example of toner contamination results upon development of a document having solid areas, which require a large concentration of toner to be deposited at a particular position on the latent image. The areas of the electrode member corresponding to the high throughput or high toner concentration areas tend to include higher or lower accumulation of toner because of this differing exposure to toner throughput. When subsequently attempting to develop another, different image, the toner accumulation on the electrode member can lead to differential development of the newly developed image corresponding to the areas of greater or lesser toner accumulation on the electrode members. The result is a darkened or lightened band in the position corresponding to the solid area of the previous image. This is particularly evident in areas of intermediate density, since these are the areas most sensitive to differences in development. These particular image defects caused by toner accumulation on the electrode wires at the development zone are referred to as wire history. FIG. 5 contains an illustration of wire contamination and wire history. Wire contamination results when fused toner forms between the electrode member and donor member due to toner fines and any toner components, such as high molecular weight, crosslinked and/or branched components, and the voltage breakdown between the wire member and the donor roll. Wire history is a change in developability due to toner or toner components sticking to the top of the electrode member.

Accordingly, there is a specific need for electrode members in the development zone of a development unit of an electrophotographic printing or copying machine which provide for a decreased tendency for toner accumulation to thereby primarily decrease wire history and wire contamination, especially at high throughput areas. There is a further need to decrease the production of unwanted surface static charges from which contaminants may not release. One possible solution is to change the electrical properties of the wire. However, attempts at decreasing toner build-up on the development wire by changing the electrical properties thereof, may result in an interference with the function of the wire and its ability to produce the formation of the toner powder cloud.

Untreated wires have been found to perform well for wire contamination, but not for wire history. The roughened stainless steel wire substrate aggravates the contamination of the wire, as the rougher surface texture promotes adhesion of toner and toner additives in contact with the wire during development and powder cloud formation. In order to suppress wire history defect, polymeric composite coatings have been used to coat the electrode. These polymeric composite coated wires have the necessary combination of properties for favorable charge interactivity and wear when used in the HSD subsystem. However, one significant drawback of this technology is that the wires are easily contaminated with toner and toner additives.

Therefore, there is a specific need for electrode members, which have a decreased tendency to accumulate toner, prevent wire history, and which also have favorable triboelectric charge exchange with toner materials. There is an additional need for electrode members which have superior mechanical properties including durability against severe wear the electrode member receives when it is repeatedly brought into contact with tough rotating donor roll surfaces. In addition, there is a need for coatings for wires that decrease or eliminate the occurrence of wire contamination and which exhibit good adhesion to un-roughened or smooth surfaces.

SUMMARY OF THE INVENTION

The invention includes, in embodiments: an apparatus for developing a latent image recorded on a surface, comprising: wire supports; a donor member spaced from the surface and being adapted to transport toner to a region opposed from the surface; an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and an organometallic coating composition on at least a portion of nonattached regions of said electrode member, wherein said organometallic coating composition comprises an organometallic composition.

In addition, embodiments include: an apparatus for developing a latent image recorded on a surface, comprising: wire supports; a donor member spaced from the surface and being adapted to transport toner to a region opposed from the surface; an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; an organometallic coating composition on at least a portion of nonattached regions of said electrode member, wherein said organometallic coating composition comprises an organometallic material and a conductive salt.

Embodiments further include: an electrophotographic process comprising: a) forming an electrostatic latent image on a charge-retentive surface; b) applying toner in the form of a toner cloud to said latent image to form a developed image on said charge retentive surface, wherein said toner is applied using a development apparatus comprising wire supports; a donor member spaced from the surface and being adapted to transport toner to a region opposed from the surface; an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image, wherein opposed end regions of said electrode member are attached to said wire supports adapted to support the opposed end regions of said electrode member; and an organometallic coating composition on at least a portion of nonattached regions of said electrode member, wherein said organometallic coating composition comprises an organometallic composition; c) transferring the toner image from said charge-retentive surface to a substrate; and d) fixing said toner image to said substrate.

The present invention provides electrode members which, in embodiments, have a decreased tendency to accumulate toner and which also, in embodiments, have favorable triboelectric charge exchange with toner materials. The present invention further provides electrode members which, in embodiments, have superior mechanical properties including durability against severe wear the electrode member receives when it is repeatedly brought into contact with tough rotating donor roll surfaces. In addition, the present invention, in embodiments, provides an electrode member coating having decreased or no ability to be contaminated by water. The coatings, in embodiments, exhibit improved adhesion to un-roughened or smooth surfaces.

BRIEF DESCRIPTION OF THE DRAWINGS

The above aspects of the present invention will become apparent as the following description proceeds upon reference to the drawings in which.

DETAILED DESCRIPTION

For a general understanding of the features of the present invention, a description thereof will be made with reference to the drawings.

Figure 1:
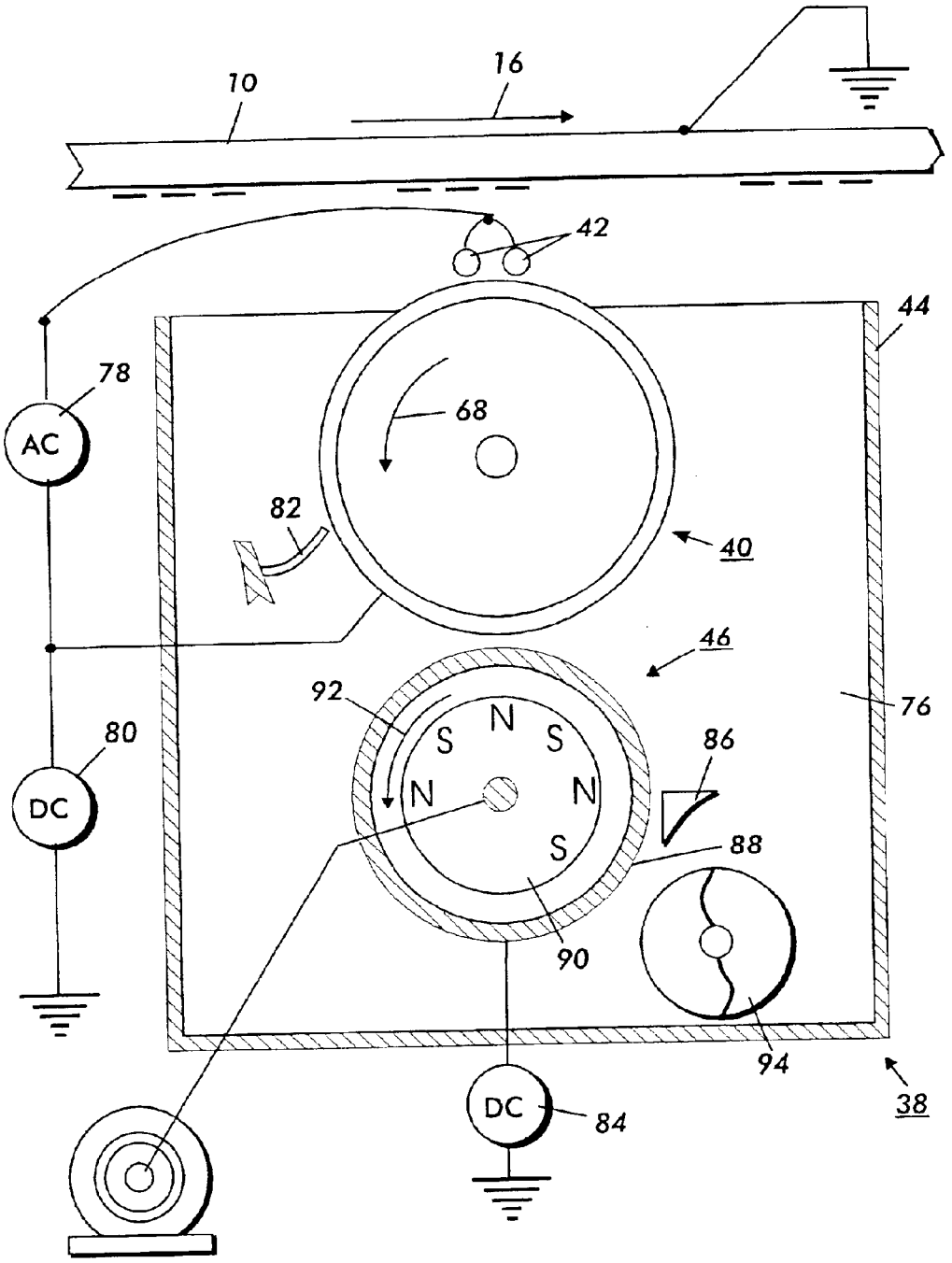
FIG. 1 is a schematic illustration of an embodiment of a development apparatus useful in an electrostatographic printing machine.

FIG. 1 shows a development apparatus used in an electrophotographic printing machine such as that illustrated and described in U.S. Pat. No. 5,124,749, the disclosure of which is hereby incorporated by reference in its entirety. This patent describes the details of the main components of an electrophotographic printing machine and how these components interact. The present application will concentrate on the development unit of the electrophotographic printing machine. Specifically, after an electrostatic latent image has been recorded on a photoconductive surface, a photoreceptor belt advances the latent image to the development station. At the development station, a developer unit develops the latent image recorded on the photoconductive surface.

Referring now to FIG. 1, in a preferred embodiment of the invention, developer unit 38 develops the latent image recorded on the photoconductive surface 10. Photoconductor 10 moves in the direction of arrow 16. Preferably, developer unit 38 includes donor roller 40 and electrode member or members 42. Electrode members 42 are electrically biased relative to donor roll 40 to detach toner therefrom so as to form a toner powder cloud in the gap between the donor roll 40 and photoconductive surface 10. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller 46 disposed interior of the chamber of housing 44 conveys the developer material to the donor roller 40. The magnetic roller 46 is electrically biased relative to the donor roller so that the toner particles are attracted from the magnetic roller to the donor roller.

More specifically, developer unit 38 includes a housing 44 defining a chamber 76 for storing a supply of two component (toner and carrier) developer material therein. Donor roller 40, electrode members 42 and magnetic roller 46 are mounted in chamber 76 of housing 44. The donor roller can be rotated in either the 'with' or 'against' direction relative to the direction of motion of belt 10. In FIG. 1, donor roller 40 is shown rotating in the direction of arrow 68. Similarly, the magnetic roller can be rotated in either the 'with' or 'against' direction relative to the direction of motion of belt 10. In FIG. 1, magnetic roller 46 is shown rotating in the direction of arrow 92. Donor roller 40 is preferably made from anodized aluminum or ceramic.

Developer unit 38 also has electrode members 42, which are disposed in the space between the belt 10 and donor roller 40. A pair of electrode members is shown extending in a direction substantially parallel to the longitudinal axis of the donor roller. The electrode members are made from of one or more thin (i.e., 50 to 100 $\mu$m in diameter) stainless steel or tungsten electrode members which are closely spaced from donor roller 40. The distance between the electrode members and the donor roller is from about 0.001 to about 45 $\mu$m, preferably about 10 to about 25 $\mu$m or the thickness of the toner layer on the donor roll. The electrode members are self-spaced from the donor roller by the thickness of the toner on the donor roller. To this end, the extremities of the electrode members supported by the tops of end bearing blocks also support the donor roller for rotation. The electrode member extremities are attached so that they are slightly above a tangent to the surface, including toner layer, of the donor structure. Mounting the electrode members in such a manner makes them insensitive to roll run-out due to their self-spacing.

As illustrated in FIG. 1, an alternating electrical bias is applied to the electrode members by an AC voltage source 78. The applied AC establishes an alternating electrostatic field between the electrode members and the donor roller is effective in detaching toner from the photoconductive member of the donor roller and forming a toner cloud about the electrode members, the height of the cloud being such as not to be substantially in contact with the belt 10. The magnitude of the AC voltage is relatively low and is in the order of about 200 to about 500 volts peak at a frequency ranging from about 9 kHz to about 15 kHz. A DC bias supply 80 which applies approximately 300 volts to donor roller 40 establishes an electrostatic field between photoconductive member of belt 10 and donor roller 40 for attracting the detached toner particles from the cloud surrounding the electrode members to the latent image recorded on the photoconductive member. At a spacing ranging from about 0.001 $\mu$m to about 45 $\mu$m between the electrode members and donor roller, an applied voltage of about 200 to about 500 volts produces a relatively large electrostatic field without risk of air breakdown. A cleaning blade 82 strips all of the toner from donor roller 40 after development so that magnetic roller 46 meters fresh toner to a clean donor roller. Magnetic roller 46 meters a constant quantity of toner having a substantially constant charge onto donor roller 40. This insures that the donor roller provides a constant amount of toner having a substantially constant charge in the development gap. In lieu of using a cleaning blade, the combination of donor roller spacing, i.e., spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantially charge on the donor roller. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the nip defined by donor roller 40 and magnetic roller 46. Toner particles are attracted from the carrier granules on the magnetic roller to the donor roller.

With continued reference to FIG. 1, an auger, indicated generally by the reference numeral 94, is located in chamber 76 of housing 44. Auger 94 is mounted rotatably in chamber 76 to mix and transport developer material. The auger has blades extending spirally outwardly from a shaft. The blades are designed to advance the developer material in the axial direction substantially parallel to the longitudinal axis of the shaft.

As successive electrostatic latent images are developed, the toner particles within the developer are depleted. A toner dispenser (not shown) stores a supply of toner particles, which may include toner and carrier particles. The toner dispenser is in communication with chamber 76 of housing 44. As the concentration of toner particles in the developer is decreased, fresh toner particles are furnished to the developer in the chamber from the toner dispenser. In an embodiment of the invention, the auger in the chamber of the housing mixes the fresh toner particles with the remaining developer so that the resultant developer therein is substantially uniform with the concentration of toner particles being optimized. In this way, a substantially constant amount of toner particles are present in the chamber of the developer housing with the toner particles having a constant charge. The developer in the chamber of the developer housing is magnetic and may be electrically conductive. By way of example, in an embodiment of the invention wherein the toner includes carrier particles, the carrier granules include a ferromagnetic core having a thin layer of magnetite overcoated with a non-continuous layer of resinous material. The toner particles may be generated from a resinous material, such as a vinyl polymer, mixed with a coloring material, such as chromogen black. The developer may comprise from about 90% to about 99% by weight of carrier and from 10% to about 1% by weight of toner. However, one skilled in the art will recognize that any other suitable developers may be used.

In an alternative embodiment of the present invention, one component developer comprised of toner without carrier may be used. In this configuration, the magnetic roller 46 is not present in the developer housing. This embodiment is described in more detail in U.S. Pat. No. 4,868,600, the disclosure of which is hereby incorporated by reference in its entirety.

Figure 2:
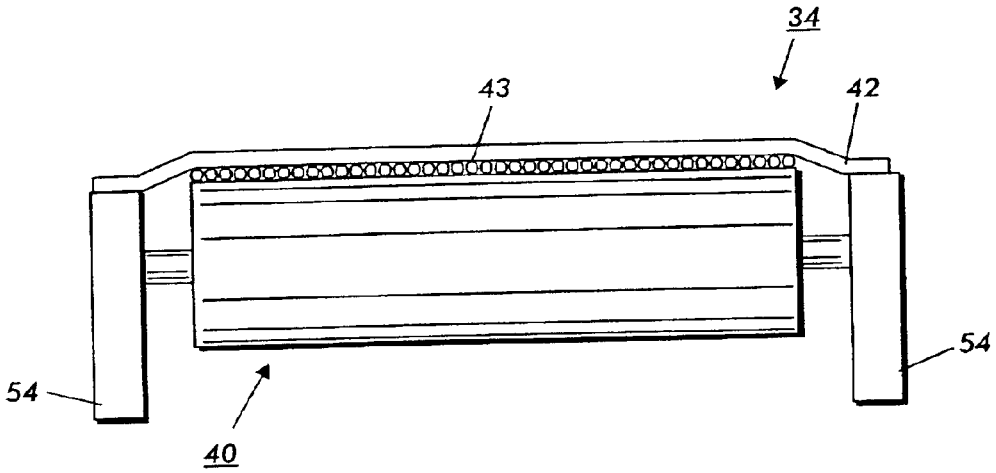
FIG. 2 is an enlarged, schematic illustration of a donor roll and electrode member representing an embodiment of the present invention.

An embodiment of the developer unit is further depicted in FIG. 2. The developer apparatus 34 comprises an electrode member 42 which is disposed in the space between the photoreceptor (not shown in FIG. 2) and the donor roll 40. The electrode 42 can be comprised of one or more thin (i.e., about 50 to about 100 $\mu$m in diameter) tungsten or stainless steel electrode members, which are lightly positioned at or near the donor structure 40. The electrode member is closely spaced from the donor member. The distance between the wire(s) and the donor is approximately 0.001 to about 45 $\mu$m, and preferably from about 10 to about 25 $\mu$m or the thickness of the toner layer 43 on the donor roll. The wires as shown in FIG. 2 are self-spaced from the donor structure by the thickness of the toner on the donor structure. The extremities or opposed end regions of the electrode member are supported by support members 54, which may also support the donor structure for rotation. In a preferred embodiment, the electrode member extremities or opposed end regions are attached so that they are slightly below a tangent to the surface, including toner layer, of the donor structure. Mounting the electrode members in such a manner makes them insensitive to roll runout due to their self-spacing.

Figure 3:
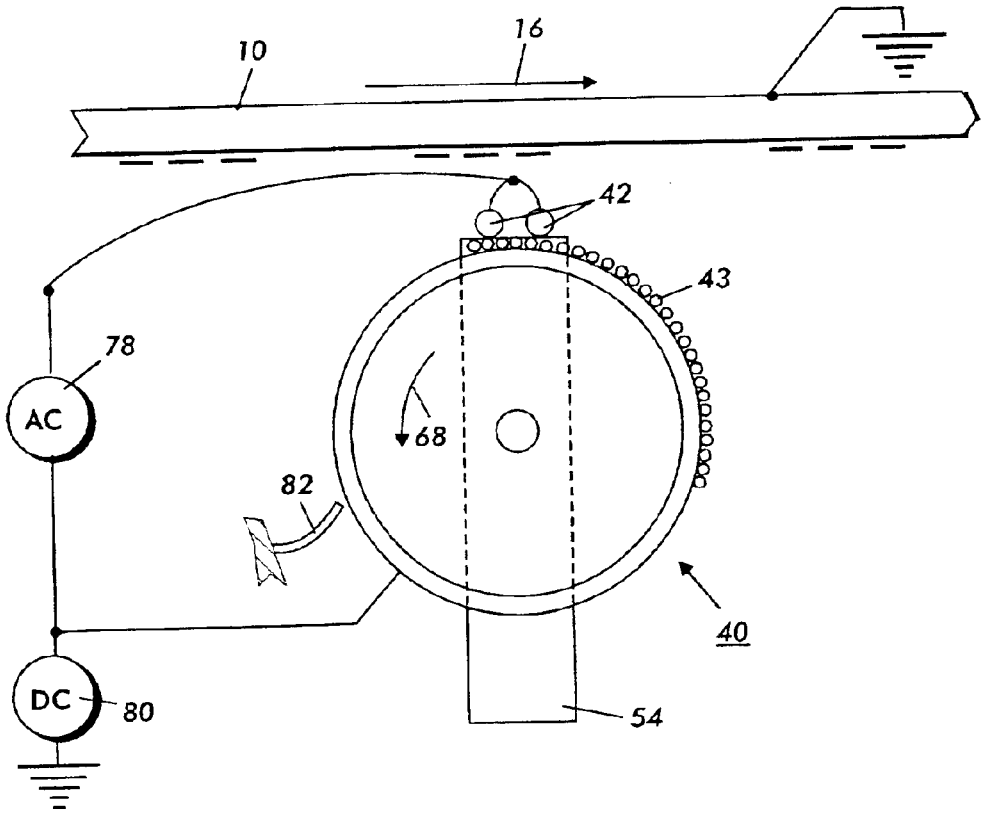
FIG. 3 is a fragmentary schematic illustration of a development housing comprising a donor roll and an electrode member from a different angle than as shown in FIG. 2.

In an alternative embodiment to that depicted in FIG. 1, the metering blade 86 is replaced by a combined metering and charging blade 86 as shown in FIG. 3. The combination metering and charging device may comprise any suitable device for depositing a monolayer of well-charged toner onto the donor structure 40. For example, it may comprise an apparatus such as that described in U.S. Pat. No. 4,459,009, wherein the contact between weakly charged toner particles and a triboelectrically active coating contained on a charging roller results in well charged toner. Other combination metering and charging devices may be employed, for example, a conventional magnetic brush used with two component developer could also be used for depositing the toner layer onto the donor structure, or a donor roller alone used with one component developer.

Figure 4:
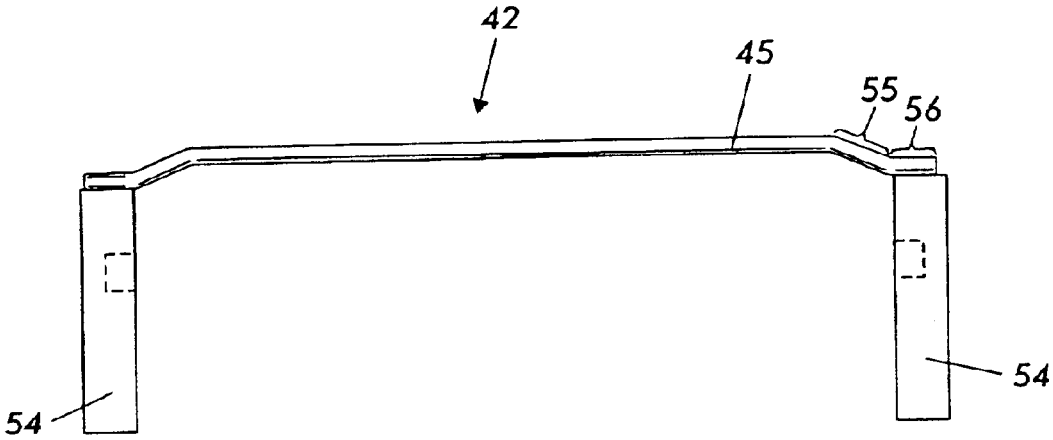
FIG. 4 is an enlarged, schematic illustration of an electrode member supported by mounting means in an embodiment of the present invention.

FIG. 4 depicts an enlarged view of a preferred embodiment of the electrode member of the present invention. Electrode wires 45 are positioned inside electrode member 42. The anchoring portions 55 of the electrode members are the portions of the electrode member, which anchor the electrode member to the support member. The mounting sections 56 of the electrode member are the sections of the electrode members between the electrode member and the mounting means 54.

Toner particles are attracted to the electrode members primarily through electrostatic attraction. Toner particles adhere to the electrode members because the adhesion force of the toner is larger than the stripping force generated by the electric field of the electrode member. Generally, the adhesion force between a toner particle and an electrode member is represented by the general expression $F_{ad}=q^2/kr^2+W$, wherein $F_{ad}$ is the force of adhesion, q is the charge on the toner particle, k is the effective dielectric constant of the toner and any dielectric coating, and r is the separation of the particle from its image charge within the wire which depends on the thickness, dielectric constant, and conductivity of the coating. Element W is the force of adhesion due to short range adhesion forces such as van der Waals and capillary forces. The force necessary to strip or remove particles from the electrode member is supplied by the electric field of the wire during half of its AC period, qE, plus effective forces resulting from mechanical motion of the electrode member and from bombardment of the wire by toner in the cloud. Since the adhesion force is quadratic in q, adhesion forces will be larger than stripping forces.

Figure 5:
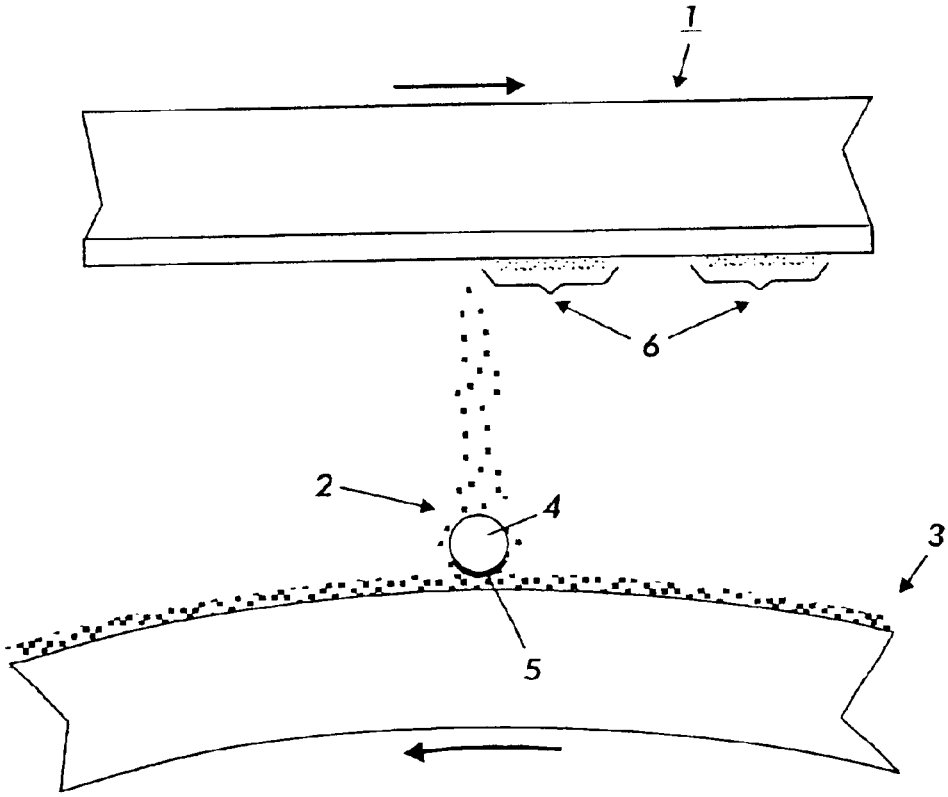
FIG. 5 is an illustration of wire contamination and wire history.

FIG. 5 contains an illustration of wire contamination and wire history. A photoreceptor 1 is positioned near wire 4 and contains an undeveloped image 6 which is subsequently developed by toner originating from donor member 3. Wire contamination occurs when fused toner 5 forms between the wire 4 and donor member 3. The problem is aggravated by toner fines and any toner components, such as high molecular weight, crosslinked and/or branched components, and the voltage breakdown between the wire member and the donor roll. Wire history is a change in developability due to toner 2 or toner components sticking to the top of the wire 4, the top of the wire being the part of the wire facing the photoreceptor.

In order to prevent the toner defects associated with wire contamination and wire history, the electrical properties of the electrode member can be changed, thereby changing the adhesion forces in relation to the stripping forces. However, such changes in the electrical properties of the electrode member may adversely affect the ability of the electrode member to adequately provide a toner cloud, which is essential for developing a latent image. The present invention is directed to an apparatus for reducing the unacceptable accumulation of toner on the electrode member while maintaining the desired electrical and mechanical properties of the electrode member. The electrode member of the present invention is coated with a material coating that reduces the significant attraction of toner particles to the electrode member, which may result in toner accumulation, but allows for favorable charge exchange with toner materials. The material coating does not adversely interfere with the mechanical or electrical properties of the electrode member. The coatings herein also have a decreased tendency for wire contamination, and a superior ability for coating adhesion to un-roughened and smooth surfaces. Materials having these qualities include compositions comprising organometallic materials.

The organometallic materials, in embodiments, decrease the accumulation of toner by assuring electrical continuity for charging the wires, and eliminate the possibility of charge build-up. In addition, such organometallic materials as described herein, in embodiments, do not interfere with the electrical properties of the electrode member and do not adversely affect the electrode's ability to produce a toner powder cloud. Moreover, the electrode member, in embodiments, maintains its tough mechanical properties, allowing the electrode member to remain durable against the severe wear the electrode member receives when it is repeatedly brought into contact with tough, rotating donor roll surfaces. Also, the electrode member maintains a "smooth" surface after the coating is applied. A smooth surface includes surfaces having a surface roughness of less than about 1 micron, preferably from about 0.01 to about 1 micron.

An organometallic compound is defined as one in which there is a bonding interaction (ionic or covalent, localized or delocalized) between one or more carbon atom(s) of an organic group or molecule and a main group, transition, lanthanide, or actinide metal atom (or atoms). Examples of suitable organometallic compositions include sol gel materials. Sol-gel chemical process is a chemical coating process based on the transition from a liquid or colloidal "sol" into a solid "gel" phase. Coatings fabricated via the sol-gel process are typically thin and wear resistant. Sol gel coatings have proven successful in wire history and wire contamination performance. These coatings exhibit good adhesion to un-roughened or smooth substrates, favorable tribological charge exchange with toner materials, and therefore, acceptable wire history performance. In embodiments, the organometallic materials comprise one or more organometallic soluble species dissolved in a carrier solvent. The organometallic species may include one or more silicon or germanium-based alkoxides as the sol gel glass percursor. The coating formulation may or may not include additional additives such as a conductive salt, pH modifier, surfactant, or structural determinant.

Examples of suitable organometallic materials include those having the formula:

$$R'_nX(OR)_{4-n},$$

wherein R can be a substituted or unsubstituted aliphatic chain having from about 1 to about 20, of from about 1 to about 10 carbons, such as an alkyl for example, methyl, ethyl, propyl, butyl, and the like. R' can be a non-hydrolizable organic constituent that exhibits the correct charge interaction in contact with the desired toner materials. For example, R' can be a substituted or unsubstituted alkoxy having from about 1 to about 20, or from about 1 to about 10 carbons, such as methoxy, ethoxy, propoxy, butoxy, or the like; or a substituted or unsubstituted alkyl group having from about 1 to about 20, or from about 1 to about 10 carbons, such as methyl, ethyl, propyl, butyl, cyanatopropyl, aminoethyl aminopropyl, glycidoxypropyl, or the like. X can be a metal or metalloid, which results in favorable charge behavior with toner, and includes multivalent metals and metalloids such as divalent, trivalent, tetravalent metals or metalloids, and includes silicon, germanium, vanadium, tantalum, niobium, chromium, copper, titanium, zirconium, lead, cerium, strontium, nickel, tin, antimony, indium, and the like, metals or metalloids. In embodiments, the metal used allows for a coating that exhibits low residual electrostatic charge buildup in contact with certain toners, for example, polyester toner. Also, n is a number of from about 1 to about 5 or from about 1 to about 3. Examples of suitable organometallic materials include 3-glycidoxypropyl trimethoxysilane, (heptadecafluoro-1,1,2,2-tetrahydrodecyl)triethoxysilane, germanium tetramethoxide, germanium ethoxide, vanadium triisopropoxide oxide, and the like.

The organometallic material is present in the composition coating in a total amount of from about 1 to about 50 percent by weight, and preferably from about 2 to about 25 percent by weight of the total coating composition. Total coating composition, as used herein, refers to the total amount by weight of organometallic material, carrier solvent, fillers, salt, pH modifier, surfactant, structural determinants, and the like.

In embodiments, the organometallic material is dissolved in a carrier solvent prior to coating. Examples of suitable carrier solvents include isopropyl alcohol (IPA), methanol, toluene, deionized water, glycol ether, ethanol, and the like.

In embodiments, a conductive salt or structural determinant is present in the coating, along with the organometallic material. Conductive salt such as a quaternary ammonium salt, has the structure $N^+(R)_4$, wherein R can be any negatively charged compound that forms a salt with N+, such as, for example, chlorine, bromine, iodine, fluorine, and the like. These salts and other salt additives can impart crystalline structure variations into the sol-gel as it dries and sinters. Examples of conductive salts include tetrabutyl ammonium bromide (TBAB), cetyltrimethyl ammonium bromide (CTAB), and the like. The conductive salt is present in the coating in an amount of from about 10 to about 50, or from about 20 to about 30 parts per hundred with respect to the organometallic component.

In embodiments, a pH modifier is present in the coating. A pH modifier is a substance that alters the pH of the entire coating solution. Examples of pH modifiers include HCl, NaOH, $HClO_4$, $H_2SO_4$, $HNO_3$, $CH_3COOH$, and the like.

Generally, the pH modifier is added in an amount that brings the pH to a desired value, which is dependent on the organometallic component. The amount is usually added slowly and monitored until the pH is at the desired level.

In embodiments, a surfactant is present in the coating. A surfactant is a surface active agent that alters the surface tension of a coating such that its wetting properties in contact with a surface or substrate are improved. Surfactants are also used as leveling aids. The end result is to provide a more uniform, smooth, pinhole-free coating. Examples of suitable surfactants include silanes, and especially those with fluorine functionality. The surfactant can be present in the coating in an amount of from about 0.1 to about 1 percent, or from about 0.2 to about 0.5 percent by weight of total coating volume.

The volume resistivity of the coated electrode is, for example, from about $10^{-10}$ to about $1^{-1}$ ohm-cm, and preferably from $10^{-5}$ to $10^{-1}$ ohm-cm. The surface roughness is less than about 5 microns and preferably from about 0.01 to about 1 micron. The coating has a relatively low surface energy of from about 5 to about 35 dynes/cm, preferably from about 10 to about 25 dynes/cm.

In an embodiment, the organometallic coating composition is coated over at least a portion of the nonattached regions of the electrode member. The nonattached region of the electrode member is the entire outer surface region of the electrode minus the region where the electrode is attached to the mounting means 54 and minus the anchoring area (55 in FIG. 4). The coating can cover the portion of the electrode member which is adjacent to the donor roll. In another embodiment, the coating composition is coated in an entire area of the electrode member located in a central portion of the electrode member and extending to an area adjacent to the nonattached portion of the electrode member. This area includes the entire surface of the electrode member minus the anchoring area (55 in FIG. 4). In an alternative embodiment, the entire length of the electrode member is coated with the material coating, including the anchoring area 55 and mounting area 56. In embodiments, at least a portion refers to the non-attached region being coated, or from about 10 to about 90 percent of the electrode member.

Toner can accumulate anywhere along the electrode member, but it will not affect development unless it accumulates in the length of the electrode member near to the donor roll or on the length closest to the photoreceptor. Therefore, in embodiments, the material coating can cover the electrode member along the entire length corresponding to the donor roll, and on the entire length corresponding to the photoreceptor.

The organometallic coating composition may be deposited on at least a portion of the electrode member by any suitable, known method. These deposition methods include liquid and powder coating, dip and spray coating, and ion beam assisted and RF plasma deposition. In one deposition method, the composition coating is coated on the electrode member by dip coating. After coating, the coating composition is preferably air dried and cured at a temperature suitable for curing the specific composition material. Curing temperatures range from about 100° F. to about 1400° F., and preferably from about 120° F. to about 1200° F.

The average thickness of the coating is from about 0.01 to about 5 $\mu$m thick, or from about 0.05 to about 2 $\mu$m thick, or from about 0.01 to about 1 $\mu$m. If the coating is applied to only a portion of the electrode member, the thickness of the coating may or may not taper off at points farthest from the midpoint of the electrode member. Therefore, the thickness of the coating may decrease at points farther away from the midpoint of the electrode.

All the patents and applications referred to herein are hereby specifically and totally incorporated herein by reference in their entirety in the instant specification.

The following Examples further define and describe embodiments of the present invention. Unless otherwise indicated, all parts and percentages are by weight.

EXAMPLES

Example 1

Preparation of Wire to be Coated

A stainless steel wire of about 3-mil thickness was cleaned to remove obvious contaminants.

A dip coating apparatus consisting of a 1 inch (diameter) by 15 inches (length) glass cylinder sealed at one end to hold the liquid coating material was used for dip coating the wire. A cable attached to a Bodine Electric Company type NSH-12R motor was used to raise and lower a wire support holder that keeps the wire taut during the coating process. The dip and withdraw rate of the wire holder into and out of the coating solution was regulated by a motor control device from B&B Motors & Control Corporation, (NOVA PD DC motor speed control). After coating, a motor driven device was used to twirl the wire around its axis while it received external heating to allow for controlled solvent evaporation. When the coating was dry and/or non-flowable, the coated wire was heated in a flow through oven using a time and temperature schedule to complete either drying or cure/ post cure of the coating.

The general procedure may include: (A) cleaning and degreasing the wire with an appropriate solvent, for example, acetone, alcohol or water, and roughened if necessary by, for example, sand paper; (B) the coating material may be adjusted to the proper viscosity and solids content by adding solids or solvent to the solution; and (C) the wire is dipped into and withdrawn from the coating solution, dried and cured/post cured, if necessary, and dipped again, if required. The coating thickness and uniformity are a function of withdrawal rate and solution viscosity (solids content in most solvent based systems), and a drying schedule consistent with the uniform solidification of the coating.

Comparative Example 2

Preparation of Organic Polymer Composition Coatings

A 2.5 mil stainless steel wire can be prepared by lightly grit blasting, degreasing with acetone and then rinsing with an isopropyl alcohol rinse, followed by a mild sodium hypochlorite solution wash, a water rinse, a dry alcohol rinse, and drying. A primer is optional in this example.

Organic coating compositions were prepared having the following formulations:

1) polytetrafluoroethylene (PTFE) green formulation, and
2) D2340—poly(amide-imide) with 15 volume percent carbon black and 10 volume percent TEFLON® FEP.

These coating compositions can be coated on the electrode wire as in accordance with the procedures outlined in Example 1. The recommended dip application temperature is preferably between 70 and 80° F., and the desired application solution viscosity is between about 20 and 30 seconds using a Zahn No. 2. The coated wire can be flashed or air-dried. However to achieve optimum release, the cure time is preferably about 10 minutes at approximately 650° F. The coating can be polished to obtain a smooth and dry thickness of 2–3 microns thick. In this case, even though the substrate is smooth, a thin, filled-polymer composite still contributes a slightly rough character to the final coating morphology, which is suitable for the wire history defect, but not for the contamination defect.

Example 3

Preparation of Organometallic Composition Coatings

A 2.5 mil stainless steel wire can be prepared by wiping with IPA and allowing air drying. The clean wire may be primed with Whitford P-51 or Dow Corning 1200 primer using any convenient technique such as the conventional spray or dip/spin methods. The following are examples of organometallic coating compositions:

4) 96:4 ratio of 3-glycidoxypropyl trimethoxysilane and (hetpadecafluoro-1,1,2,2-tetrahydrodecyl) triethoxysilane, in a 2% solution in IPA; (Z6F964, FIG. 6)

5) germanium tetramethoxide, 4% in IPA and 20 pph tetrabutylammonium bromide (with respect to the germanium tetramethoxide); (90-12, FIG. 6)

6) germanium tetraethoxide, 4% in IPA and 20 pph tetrabutylammonium bromide (with respect to the germanium tetraethoxide); (90-13, FIG. 6)

7) vanadium triisopropoxide oxide, 2% in methanol and 20 pph tetrabutylammonium bromide (with respect to the vanadium triisopropoxide oxide). (97-28, FIG. 6)

These dispersions can then be dip coated onto an electrode as described in Example 1. A coating flash or air dry is optional. However, to achieve optimum release, the cure time is preferably about 10 minutes at approximately 650° F. The coating can be polished to obtain a smooth and dry thickness of 2–3 microns thick.

Example 4

Comparison of Organic Coating to Organometallic Coating

The coating formulations of Examples 2 and 3 were coated onto stainless steel plastes via spin coating and sintered at 800–100° F. Two plates coated with the same coating were used in the method. In addition, a plain 304V stainless steel wire (SS) was also used in the experiment (sample 3). A small amount of toner was placed on one plate and the other coating plate was rubbed against the toner pile in order to form a thin toner layer on the surfaces and initiate friction between the toner and the coating surface. A thin layer of toner was then trapped between the two plates. The plates were then rubbed together lightly in a circular pattern. The top of the toner (for example, a polyester with pigment and additives toner) layer was measured with an electrostatic voltmeter (ESV). This indicated the amount of charge on the toner layer. Then, the toner was blown off the plate with pressurized air and the bare plate was re-measured with the ESV probe. When the difference between the two measured voltages was closest to zero, the coating was believed to be most suitable for favorable wire history performance. The plate data for the coatings is shown in FIG. 6.

Figure 6:
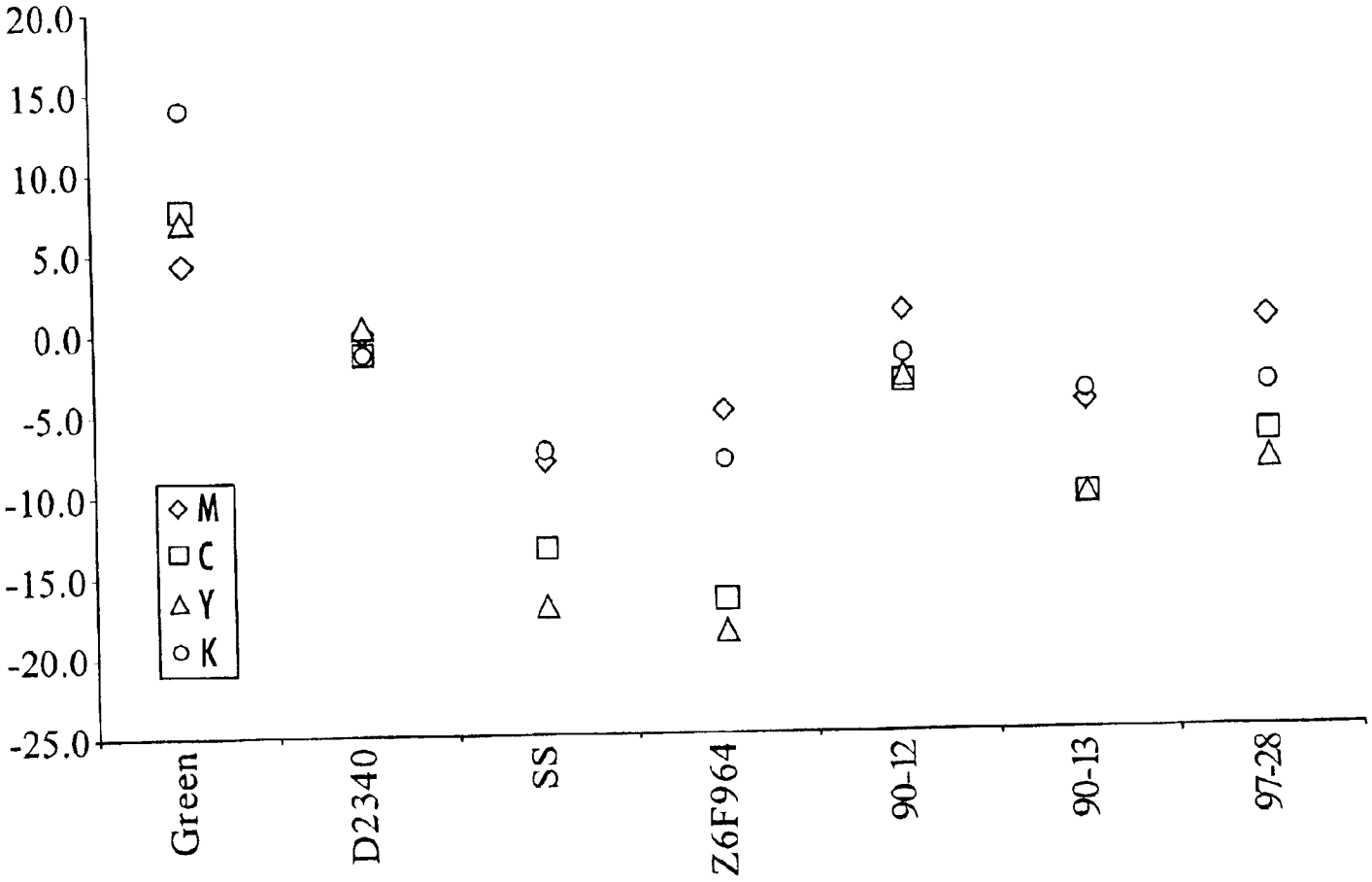
FIG. 6 is a graph of voltage (amount of charge in the toner layer) versus wire coating type, and indicates wire history for various coatings.

The results of FIG. 6 demonstrate that the organometallic materials when applied to a smooth wire in a thin surface treatment, do not contribute to the contamination defect as readily as a roughened wire. The plate measurement is a screening test for the wire history defect. If a coating performs favorably in the plate test, it is coated in a wire and fixture tested for the contamination performance. The data in the graph shows the difference between the two ESV measurements. It indicates the charge build-up between an experimental coating and a specific color toner (M=magenta, C=cyan, Y=yellow, and K=black). The thickness and adhesion of this class of coatings can be modified in order to counteract any premature wear and eventual wire history performance shortfalls.

Stainless steel does not provide the same charge interaction behavior with the toner as the coated wires. When toner collides with the top of the wire, charges are exchanged and wrong-sign toner particles are loosely attracted to the top of the wire, resulting in ghost images ("history") on subsequent prints in those areas, resulting in differential developability. Coatings negate this charge build-up behavior in the surface of the wire. Also, D2340 (a polymeric composite coating) and the germanium-based coatings on wires, have similar wire history performance. However, the organometallic coatings are thin and smooth, and do not allow for random contamination onto the bottom side surface of the wire. The roughened filled-polymer coated wire contributes to a build-up of toner and toner additives on the bottom of the wire. Therefore, the organometallic coatings provide for improved wire history and a decrease in wire contamination.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. An apparatus for developing a latent image recorded on a surface, comprising:

wire supports;

a donor member spaced from the surface and being adapted to transport toner to a region opposed from the surface;

an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to said wire supports adapted to support the opposed end regions of said electrode member; and an organometallic coating composition on at least a portion of nonattached regions of said electrode member, wherein said organometallic coating composition comprises an organometallic material having the following formula:

$$R'_nX(OR)_{4-n},$$

wherein R is an aliphatic chain having from about 1 to about 20 carbons; R' is selected from the group consisting of an alkyl having from about 1 to about 20 carbons and an alkoxy having from about 1 to about 20 carbons; X is selected from the group consisting of a metal and a metalloid; and n is a number of from about 1 to about 5.

2. An apparatus in accordance with claim 1, wherein R is an aliphatic chain having from about 1 to about 10 carbons.

3. An apparatus in accordance with claim 2, wherein R is selected from the group consisting of methyl, ethyl, propyl, butyl and pentyl.

4. An apparatus in accordance with claim 1, wherein R' is an alkyl having from about 1 to about 10 carbons.

5. An apparatus in accordance with claim 4, wherein R' is selected from the group consisting of cyanatopropyl, aminoethyl, aminopropyl and glycidoxypropyl.

6. An apparatus in accordance with claim 1, wherein R' is an alkoxy having from about 1 to about 10 carbons.

7. An apparatus in accordance with claim 6, wherein R' is selected from the group consisting of methoxy, ethoxy, propoxy, butoxy and pentoxy.

8. An apparatus in accordance with claim 1, wherein X is selected from the group consisting of silicon, germanium, vanadium, tantalum, niobium, chromium, copper, titanium, zirconium, lead, cerium, strontium, nickel, tin, antimony and indium.

9. An apparatus in accordance with claim 1, wherein n is a number of from about 1 to about 3.

10. An apparatus in accordance with claim 1, wherein said organometallic material is selected from the group consisting of 3-glycidoxypropyl trimethoxysilane, germanium tetramethoxide, germanium tetraethoxide, and vanadium triisopropaxide oxide.

11. An apparatus in accordance with claim 1, wherein said organometallic composition further comprises a carrier solvent.

12. An apparatus in accordance with claim 1, wherein said organometallic composition further comprises a conductive salt.

13. An apparatus in accordance with claim 12, wherein said conductive salt is selected from the group consisting of tetrabutyl ammonium bromide and cetyltrimethyl ammonium bromide.

14. An apparatus in accordance with claim 1, wherein said organometallic composition further comprises a pH modifier.

15. An apparatus in accordance with claim 1, wherein said organometallic material is present in said organometallic coating composition in an amount of from about 1 to about 50 percent by weight of the organometallic coating composition.

16. An apparatus in accordance with claim 1, wherein said organometallic coating composition is present on from about 10 to about 90 percent of said electrode member.

17. An apparatus in accordance with claim 1, wherein said organometallic coating composition is of a thickness of from about 0.01 $\mu$m to about 5 $\mu$m.

18. An apparatus in accordance with claim 1, wherein said electrode member includes at least one thin diameter wire.

19. An apparatus in accordance with claim 1, wherein said thin diameter wires have a diameter of from about 50 to about 100 $\mu$m.

20. An apparatus in accordance with claim 1, wherein said donor member is closely spaced from said donor member a distance of from about 0.001 to about 45 $\mu$m.

21. An apparatus for developing a latent image recorded on a surface, comprising:

wire supports;

a donor member spaced from the surface and being adapted to transport toner to a region opposed from the surface;

an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to said wire supports adapted to support the opposed end regions of said electrode member; and an organometallic coating composition on at least a portion of nonattached regions of said electrode member, wherein said organometallic coating composition comprises an organometallic material having the following formula:

$$R'_nX(OR)_{4-n},$$

wherein R is an aliphatic chain having from about 1 to about 20 carbons; R' is selected from the group consisting of an alkyl having from about 1 to about 20 carbons and an alkoxy having from about 1 to about 20 carbons; X is selected from the group consisting of a metal and a metalloid; and n is a number of from about 1 to about 5, and a conductive salt.

22. An electrophotographic process comprising:

a) forming an electrostatic latent image on a charge-retentive surface;

b) applying toner in the form of a toner cloud to said latent image to form a developed image on said charge retentive surface, wherein said toner is applied using a development apparatus comprising wire supports; a donor member spaced from the surface and being adapted to transport toner to a region opposed from the surface; an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image, wherein opposed end regions of said electrode member are attached to said wire supports adapted to support the opposed end regions of said electrode member; and an organometallic coating composition on at least a portion of nonattached regions of said electrode member, wherein said organometallic coating composition comprises an organometallic material having the following formula:

$$R'_nX(OR)_{4-n},$$

wherein R is an aliphatic chain having from about 1 to about 20 carbons; R' is selected from the group consisting of an alkyl having from about 1 to about 20 carbons and an alkoxy having from about 1 to about 20 carbons; X is selected from the group consisting of a metal and a metalloid; and n is a number of from about 1 to about 5, and a conductive salt;

c) transferring the toner image from said charge-retentive surface to a substrate; and d) fixing said toner image to said substrate.

* * * * *